US008984698B1

(12) United States Patent
Olsson

(10) Patent No.: US 8,984,698 B1
(45) Date of Patent: Mar. 24, 2015

(54) LIGHT WEIGHT SEWER CABLE

(75) Inventor: Mark S. Olsson, San Diego, CA (US)

(73) Assignee: Seescan, Inc., San Diego, CA (US)

( * ) Notice: Subject to any disclaimer, the term of this patent is extended or adjusted under 35 U.S.C. 154(b) by 0 days.

(21) Appl. No.: 13/589,948

(22) Filed: Aug. 20, 2012

Related U.S. Application Data

(63) Continuation of application No. 11/679,092, filed on Feb. 26, 2007, now abandoned.

(60) Provisional application No. 60/787,471, filed on Mar. 30, 2006.

(51) Int. Cl.

| | |
|---|---|
| ***B08B 1/00*** | (2006.01) |
| ***B08B 7/00*** | (2006.01) |
| ***H01B 7/08*** | (2006.01) |
| ***B08B 9/045*** | (2006.01) |

(52) U.S. Cl.
CPC ..... *B08B 9/045* (2013.01)
USPC ..... 15/104.31; 15/104.03; 15/104.32; 15/104.33; 428/375; 428/377; 428/379; 174/126.1; 174/128.1

(58) Field of Classification Search
None
See application file for complete search history.

(56) References Cited

U.S. PATENT DOCUMENTS

| | | | | | |
|---|---|---|---|---|---|
| 1,851,766 | A | * | 3/1932 | Hotchkiss, Jr. | 15/104.33 |
| 1,910,768 | A | * | 5/1933 | Hotchkiss, Jr. | 15/104.33 |
| 2,187,873 | A | * | 1/1940 | Bratz | 138/130 |
| 2,244,735 | A | * | 6/1941 | Silverman | 15/104.33 |
| 3,015,969 | A | * | 1/1962 | Bratz | 74/502.5 |
| 3,149,480 | A | * | 9/1964 | Hunt | 464/58 |
| 3,176,538 | A | * | 4/1965 | Hurlow | 74/502.5 |
| 3,183,301 | A | * | 5/1965 | Kompanek, Jr. et al. | 174/108 |
| 3,240,082 | A | * | 3/1966 | Bratz | 74/502.5 |
| 3,307,421 | A | * | 3/1967 | Gilmore | 74/501.6 |
| 3,457,580 | A | * | 7/1969 | Meyers | 15/104.33 |
| 3,950,934 | A | * | 4/1976 | Irwin | 57/223 |
| 4,364,140 | A | * | 12/1982 | Irwin | 15/104.33 |
| 4,926,518 | A | * | 5/1990 | Mikol | 15/104.33 |
| 5,348,424 | A | * | 9/1994 | Tateyama et al. | 405/262 |
| 5,457,288 | A | * | 10/1995 | Olsson | 174/117 R |
| 6,173,787 | B1 | * | 1/2001 | Wittrisch | 166/384 |
| 2009/0083915 | A1 | * | 4/2009 | Cicchelli et al. | 15/3 |

FOREIGN PATENT DOCUMENTS

| | | | |
|---|---|---|---|
| GB | 1262441 | * | 2/1972 |

* cited by examiner

*Primary Examiner* — Jill Gray
(74) *Attorney, Agent, or Firm* — Steven C. Tietsworth, Esq.

(57) ABSTRACT

Lightweight sewer cable that may include an elongate central resilient non-metallic core member, an elongate metallic helical coil spring surrounding the core member, and an elongate non-metallic spacer between the core member and the coil spring are disclosed.

17 Claims, 20 Drawing Sheets

LIGHT WEIGHT SEWER CABLE

CROSS-REFERENCE TO RELATED APPLICATIONS

This application is a continuation of and claims priority to co-pending U.S. patent application Ser. No. 11/679,092, filed Feb. 26, 2007, entitled LIGHT WEIGHT SEWER CABLE, which claims priority under 35 U.S.C. §119(e) to U.S. Provisional Patent Application Ser. No. 60/787,471, filed Mar. 30, 2006, entitled LIGHT WEIGHT SEWER CABLE. The content of each of these applications is hereby incorporated by reference herein in its entirety for all purposes.

FIELD

This disclosure relates generally to devices for cleaning sewer pipes and drain pipes. More particularly, but not exclusively, the disclosure relates to cables using to push cutter heads or other elements for deployment down pipes for clearing them of obstructions.

BACKGROUND

For many years in commercial pipe clean out operations, a cutting or clearing head 1 (as shown in FIG. 1) has been forced down an underground pipe 2 with a flexible sewer cable 3 that is advanced by a technician 4 from a portable rotating drum or reels. The sewer cable 3 is rotated so that the cutting head 1 will clear roots 6, debris and other obstructions. Therefore the sewer cable 3 must be constructed so that it is capable of transmitting substantial torque generated by a powerful electric motor (not illustrated) and transferred through a belt and/or gear drive (not illustrated). The sewer cable 3 must also be sufficiently stiff to enable it to be forced down the pipe 2 as much as approximately one hundred feet or more yet must also be flexible enough to negotiate turns 2*a* and 2*b* having a relatively tight radius.

One form of conventional sewer cable 7 (FIG. 2) comprises an elongate flexible helical steel helical spring. FIG. 3A illustrates another prior art sewer cable 8 comprising an inner core made of a smaller elongate helical steel spring 9 and a jacket made of a larger elongate helical steel spring 10 wound in a direction opposite that of the core 9. FIG. 3B illustrates another prior art sewer cable 11 having a central aircraft cable 12 surrounded by the smaller helical spring 9 which is in turn surrounded by the larger helical spring 10. FIG. 3C illustrates another prior art sewer cable 13 similar to the sewer cable 11 of FIG. 3B, except that the sewer cable 13 of FIG. 3C includes a central aircraft cable 12 surrounded by a plastic or elastomeric jacket 14 made of Nylon, for example.

Conventional sewer cables are typically very heavy. This is a great disadvantage when a plumber or other technician must manually carry up stairs a snake system including fifty to one hundred feet, or more, of sewer cable. Conventional sewer cables are also not well adapted for connection to different heads such as cutting heads, jetting heads and camera heads. Moreover sewer cables currently in commercial use can be dangerous in the event that they kink between the head and the drum or a loop flies free and ensnares the technician. The risk of injury is increased where close laid windings are used in the coil springs in order to increase the torque transmission capabilities of a sewer cable. Conventional sewer cables tend to shorten and lengthen during clean out operations, making it extremely difficult to incorporate electrical conductors that do not end up shorting.

SUMMARY

In one aspect, the disclosure relates to a lighter sewer cable than those currently in use that is still capable of transmitting substantial torque to a cutting head. In another aspect the disclosure relates to a safer sewer cable than those in current use. In another aspect, the disclosure relates to a sewer cable that can be connected to a wide variety of cutting heads. In another aspect, the disclosure relates to a sewer cable that can accommodate electrical conductors while reducing the likelihood of shorts. In another aspect, the disclosure relates to a sewer cable having an elongate central resilient non-metallic core member, an elongate metallic helical coil spring surrounding the core member, and an elongate non-metallic spacer between the core member and the coil spring.

Various additional aspects, details, features, and functions of various embodiments are further described herein in conjunction with the appended drawing figures.

BRIEF DESCRIPTION OF THE DRAWINGS

The present application may be more fully appreciated in connection with the following detailed description taken in conjunction with the accompanying drawings, wherein.

DETAILED DESCRIPTION OF EMBODIMENTS

Figure 1:
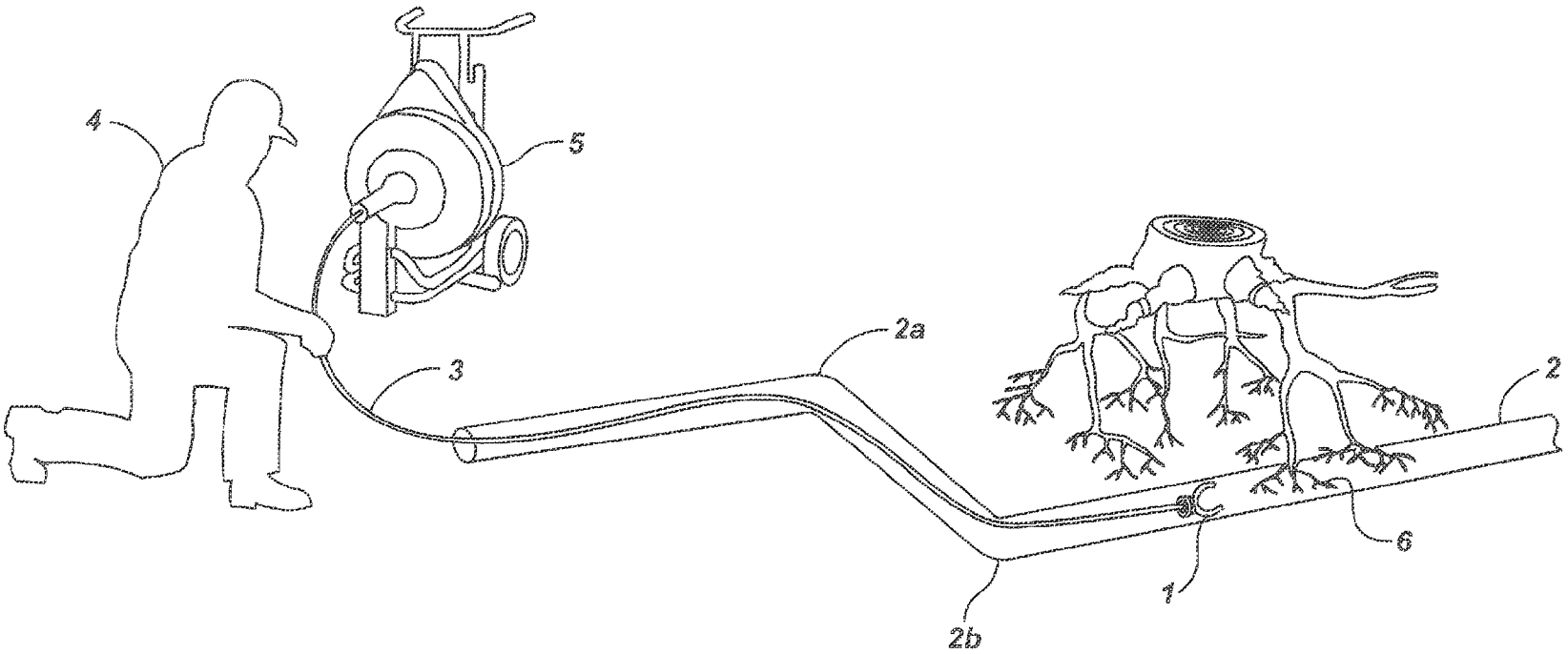
(PRIOR ART) FIG. 1
FIG. 1 illustrates a technician clearing roots from a subterranean pipe using a cutting head rotated by a conventional sewer cable.
Figure 2:
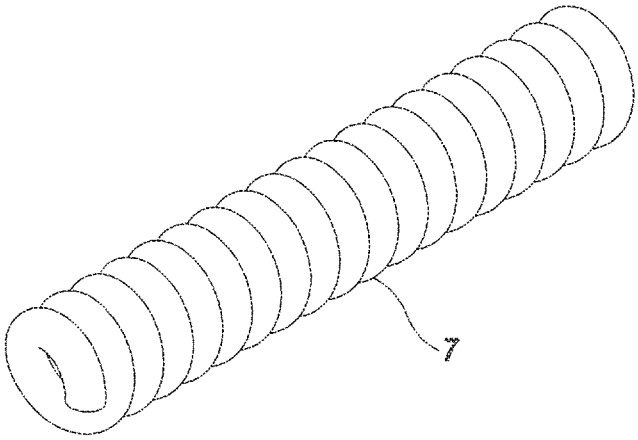
(PRIOR ART) FIG. 2
FIGS. 2, 3A, 3B and 3C are fragmentary isometric views illustrating the construction of various prior art sewer cables.
Figure 3A:
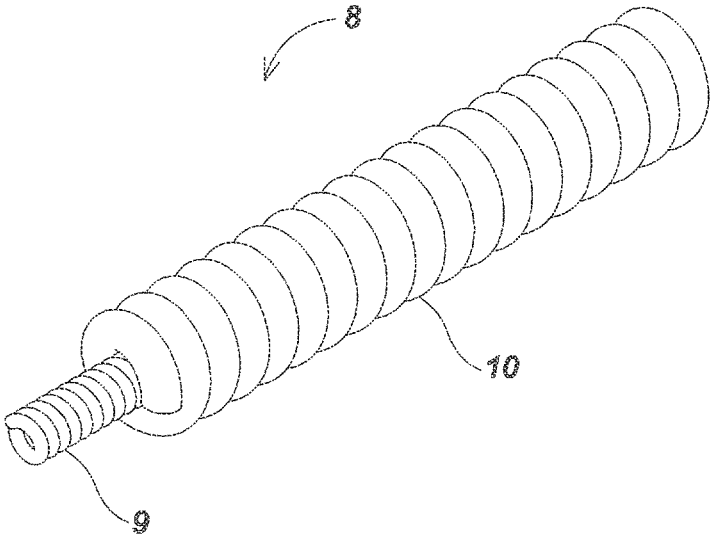
(PRIOR ART) FIG. 3A
Figure 3B:
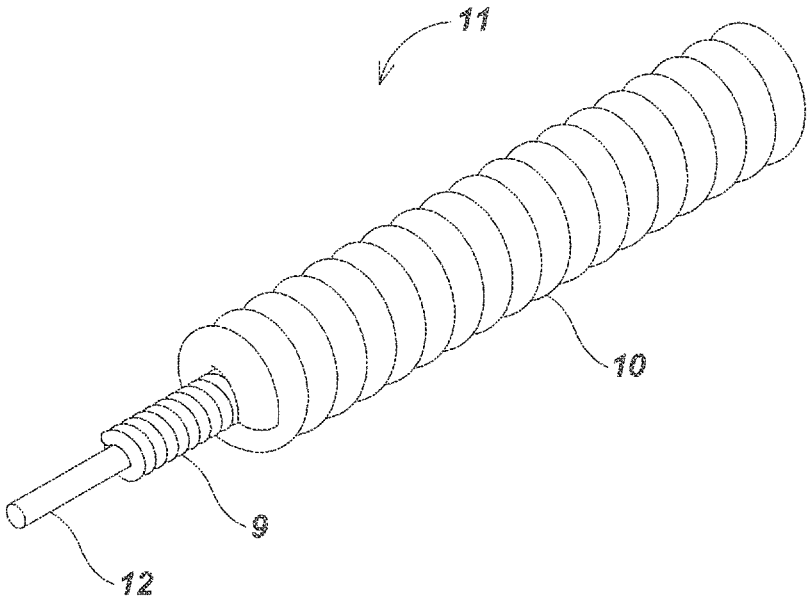
(PRIOR ART) FIG. 3B
Figure 3C:
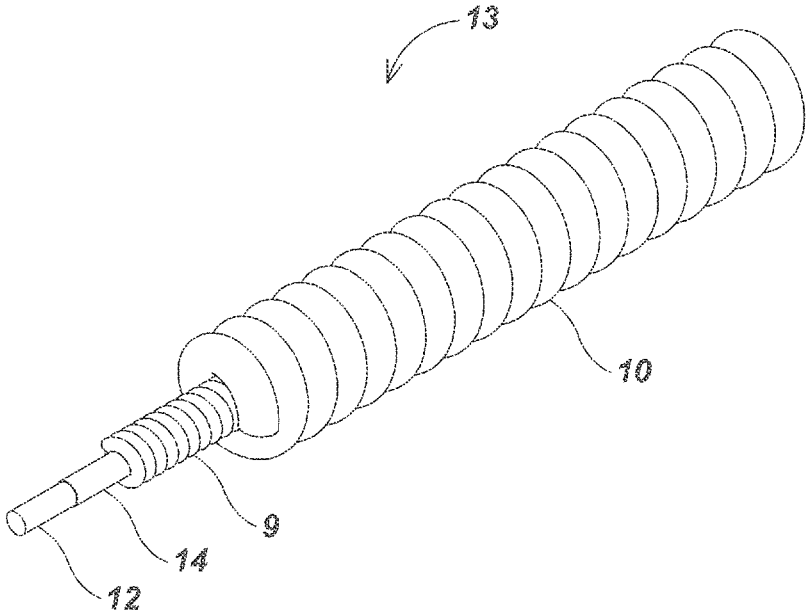
(PRIOR ART) FIG. 3C
Figure 4A:
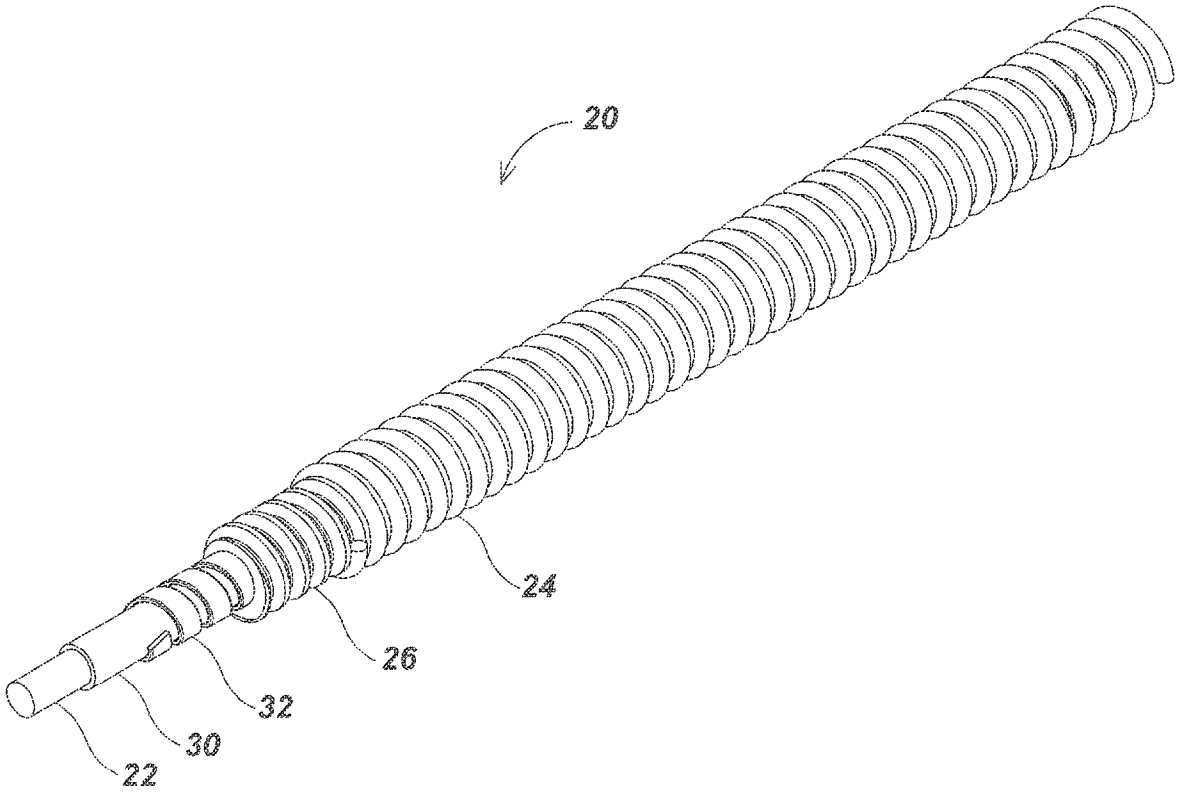
FIG. 4A is a fragmentary isometric view of a sewer cable in accordance with a first embodiment.
Figure 4B:
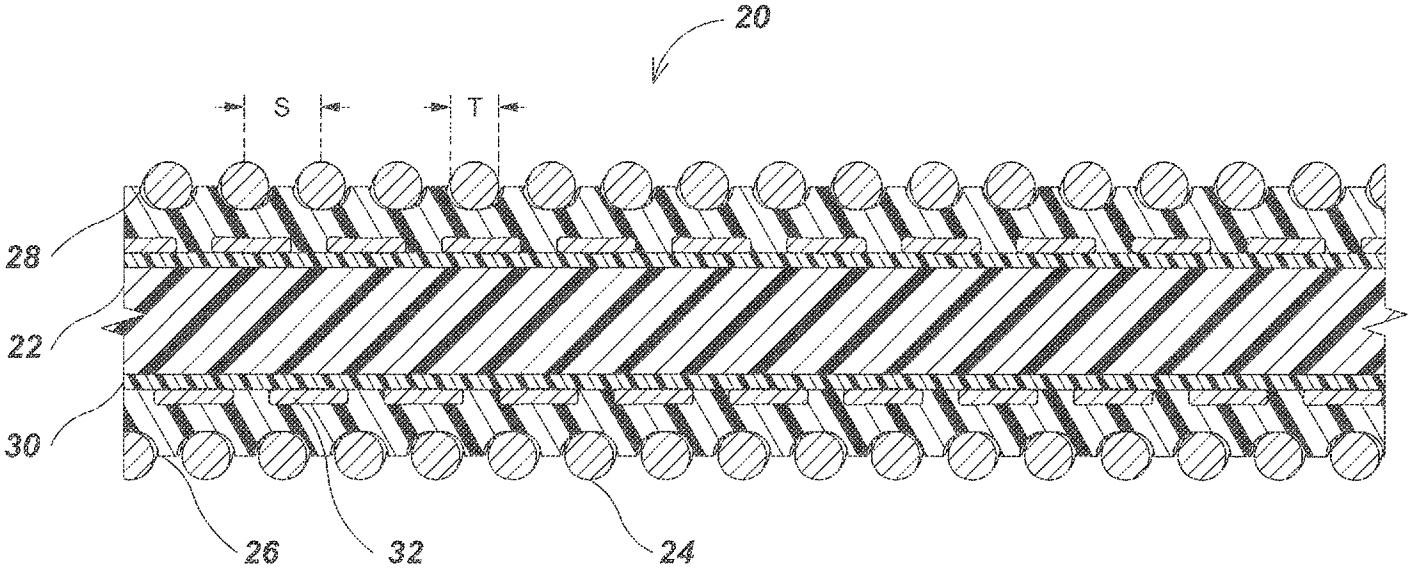
FIG. 4B is a longitudinal sectional view of the sewer cable of FIG. 4A.

Referring to FIGS. 4A and 4B, in accordance with an embodiment of the present invention, a sewer cable 20 has an elongate central resilient non-metallic core member 22, an elongate metallic helical coil spring 24 surrounding the core member, and an elongate non-metallic spacer 26 between the core member 22 and the coil spring 24. The spacer 26 is formed with a helical groove 28 (FIG. 4B) that receives the coil spring 24 and maintains the coil spring 24 in a predetermined pitch in which its adjacent turns are spaced apart a distance S. The helical groove 28 has a predetermined width slightly larger than a thickness T of the coil spring to limit the degree of lateral bending of the sewer cable 20 and prevent damage to the core member 22.

The core member 22 is made of a composite material such as glass reinforced plastic (GRP) consisting of glass fibers held together with a binder to provide high strength, sufficient stiffness, yet sufficient resiliency. Composite materials incorporating other fibers besides glass can also be used for the core member 22, such as carbon, boron and synthetic fibers such as KEVLAR (trademark) fibers.

The coil spring 24 is preferably made of steel or stainless steel. The spacer 26 is preferably made of a lightweight, flexible non-metallic elastomeric material such as polyethylene, ultra high molecular weight (UHMW) polyethylene, polypropylene, or Nylon. Other durable lightweight synthetic materials may be used for the spacer 26. The helical groove 28 may be molded, machined, thermally formed, or laser cut into the exterior surface of the spacer 26.

The sewer cable 20 includes an elongate non-metallic jacket 30 (FIG. 4A) between the core member 22 and the spacer 26. The jacket 30 is preferably in intimate contact with the exterior of the core member and may be made of a plastic material such as Nylon. An elongate helical flat wire 32 is positioned between the jacket 30 and the spacer 26 and is wound in a direction opposite to the direction in which the turns of the coil spring 24 are wound.

The sewer cable 20 of FIGS. 4A and 4B, when suitably dimensioned, provides sufficient rigidity (stiffness) such that it can push a cutting head (not illustrated) connected to its distal end hundreds of feet down a sewer pipe. It also has sufficient flexibility to negotiate tight turns. In addition it can transmit substantial torque in both clockwise and counterclockwise directions generated by a rotational drive mechanism (not illustrated) of conventional design. The sewer cable 20 also has sufficient tensile strength to allow the cutting head to be pulled free should it become lodged in the pipe.

Importantly, the sewer cable 20 can weigh less than half that of the weight of conventional sewer cables having similar performance capabilities since a large proportion of its cross section is made up of non-metallic materials. This greatly reduces the weight of the coil of sewer cable carried on the drum or reel of a motorized snake apparatus. In addition, the lighter sewer cable has less chance of flying off the drum or reel when it is rotating, and presents less risk of injury should it strike a technician. The lighter sewer cable can be rotated at higher speeds as needed for the cutting head to clear an obstruction.

The exterior of the coil spring 24 can be externally engaged by a conventional track-nut drive mechanism for forcing the sewer cable 20 down the pipe or withdrawing the sewer cable 20 from the pipe. When the sewer cable 20 is being forced down the pipe the flat wire 32 will tighten against the jacket 30 thus limiting the amount of torque transferred to the composite core member 22, preventing damage to the core member 22. The coil spring 24 will loosen while the flat wire 32 tightens since they are wound in opposite directions. The helical flat wire 32 is preferably made of steel and its flat shape, combined with the protection of the stress limiting jacket 30, prevents point loading on the core member 22 that could result in damage to the core member 22. The helical flat wire 32 has an open pitch with gaps between adjacent turns that are sufficiently large to permit the sewer cable 20 to flex laterally to the degree necessary to negotiate the tightest turns in the sewer pipe normally expected to be encountered. The function of the helical flat wire 32 is to absorb torsional loads to prevent damage to the core member 22, whose primary function is to provide resiliency so that the sewer cable 20 can be pushed long distances down the pipe.

The solid core member 22 of the sewer cable 20 can also be replaced with a video push cable of the type disclosed in U.S. Pat. Nos. 5,808,239 and 5,939,679, both granted to Mark S. Olsson, the entire disclosures of which are hereby incorporated by reference. This allows the sewer cable to be coupled to a video camera head (not illustrated) such as that disclosed in pending U.S. patent application Ser. No. 10/858,628 filed Jun. 1, 2004, of Mark S. Olsson et al., the entire disclosure of which is hereby incorporated by reference. Suitable termination assemblies for the proximal and distal ends of this type of video push cable are disclosed in U.S. Pat. No. 6,958,767 granted to Mark S. Olsson et al., the entire disclosure of which is hereby incorporated by reference.

Figure 5A:
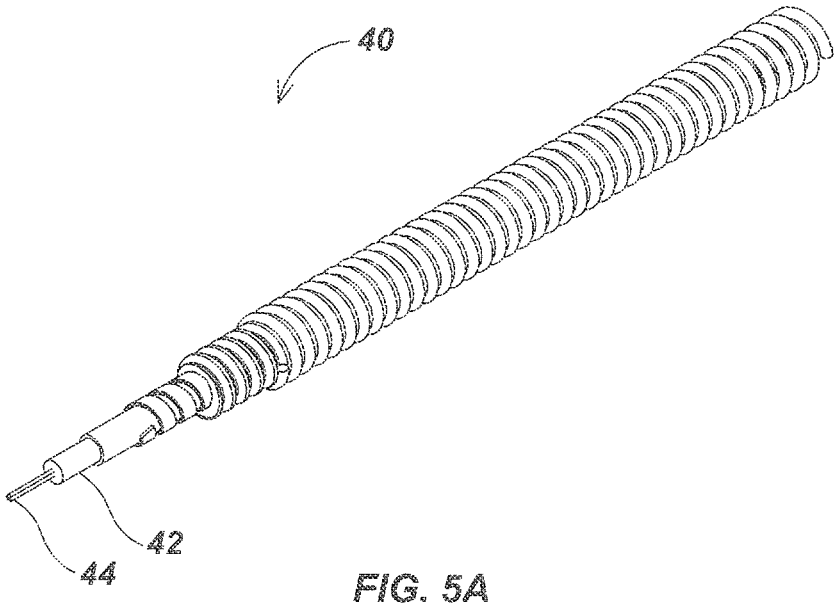
FIG. 5A is a fragmentary isometric view of a sewer cable in accordance with a second embodiment.
Figure 5B:
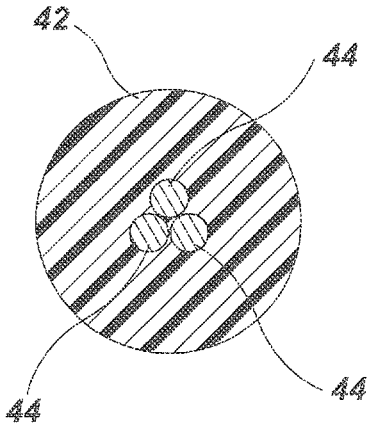
FIG. 5B is an enlarged cross-sectional view of the core member of the embodiment of FIG. 5A illustrating its centrally located wires.

Another embodiment of a sewer cable 40 in accordance with the present invention is illustrated in FIG. 5A. It has a construction similar to the sewer cable 20 except that the non-metallic core member 42 (FIG. 5B) has three centrally positioned insulated conductors (wires) 44 for the transmission of power, control data, sensor return data, and the like. An oscillating signal can be applied to one of these conductors to allow the sewer cable to be traced with a locator of the type disclosed in U.S. Pat. No. 7,009,399 granted to Mark S. Olsson et al.

Figure 5C:
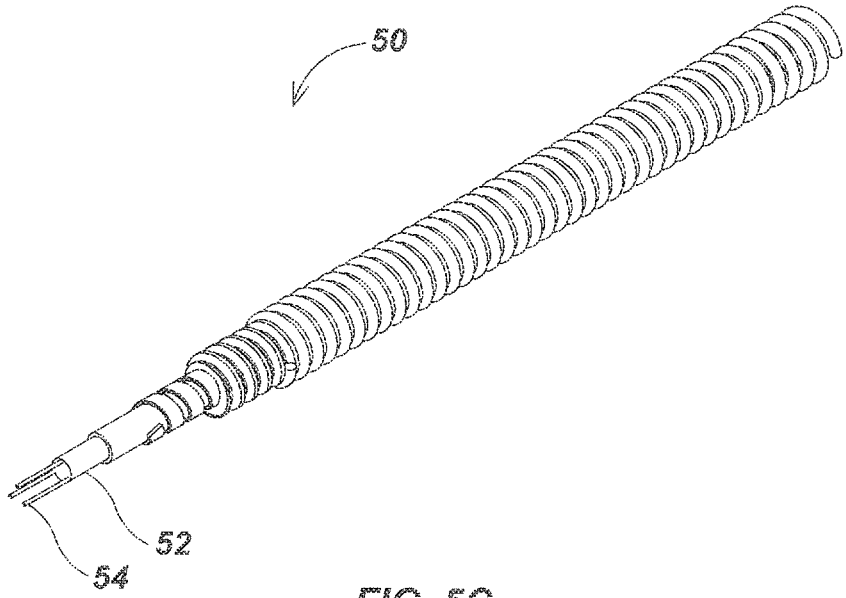
FIG. 5C is a fragmentary isometric view of a sewer cable in accordance with a third embodiment.
Figure 5D:
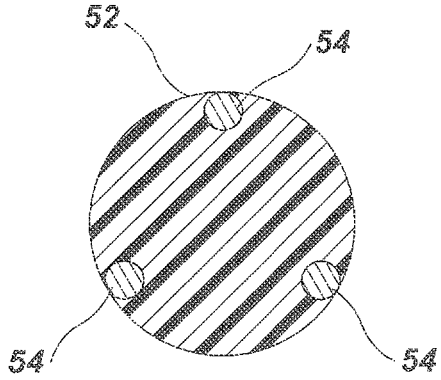
FIG. 5D is an enlarged cross-sectional view of the core member of the embodiment of FIG. 5C illustrating its externally embedded conductors.

Another embodiment of a sewer cable 50 in accordance with the present invention is illustrated in FIG. 5C. It has a construction similar to the sewer cable 40 except that the non-metallic core member 52 (FIG. 5D) has three conductors 54 embedded in the exterior thereof which do not require insulation since they are spaced apart.

Figure 6A:
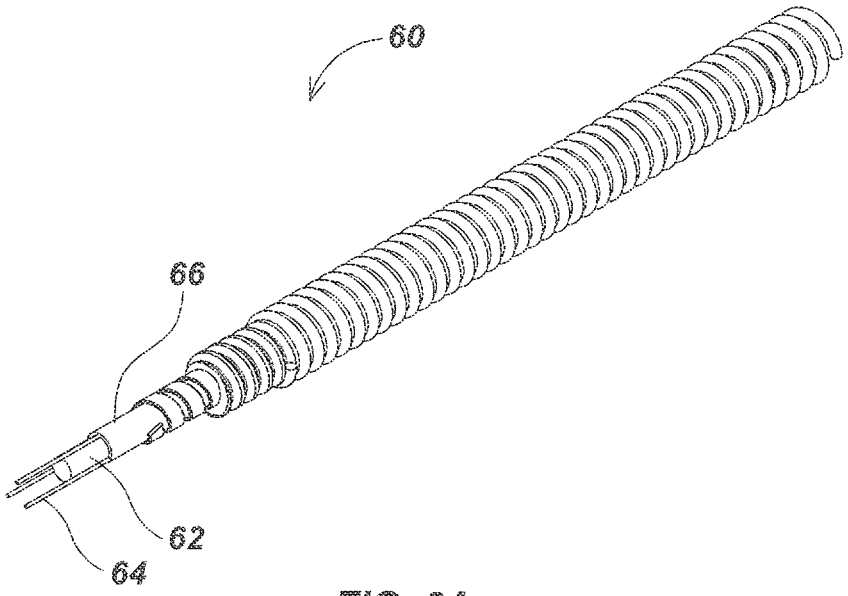
FIG. 6A is a fragmentary isometric view of a sewer cable in accordance with a fourth embodiment.
Figure 6B:
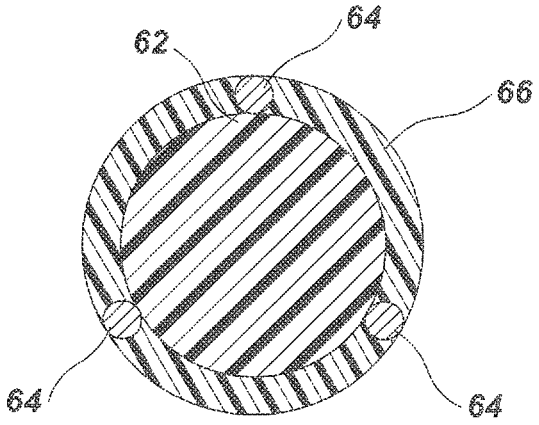
FIG. 6B is an enlarged cross-sectional view of the core member of the embodiment of FIG. 6A illustrating its conductors that overlap the external surface of the core member and are surrounded by a jacket.

Another embodiment of a sewer cable 60 in accordance with the present invention is illustrated in FIG. 6A. It has a construction similar to the sewer cable 50 except that the non-metallic core member 62 (FIG. 6B) has a round cross-section and three conductors 64 overlap the round exterior thereof. A protective jacket 66 made of Nylon or other suitable material surrounds the conductors 64 and core member 62.

Another embodiment of a sewer cable 70 in accordance with the present invention is illustrated in FIG. 7 A. It has a construction similar to the sewer cable 40 of FIG. SA except that the non-metallic core member 72 (FIG. 7B) has four centrally located insulated conductors 74 for power, control data, sensor return and a tracer. A protective jacket 76 made of Nylon or other suitable material surrounds the conductors 74 and core member 72.

Figure 7A:
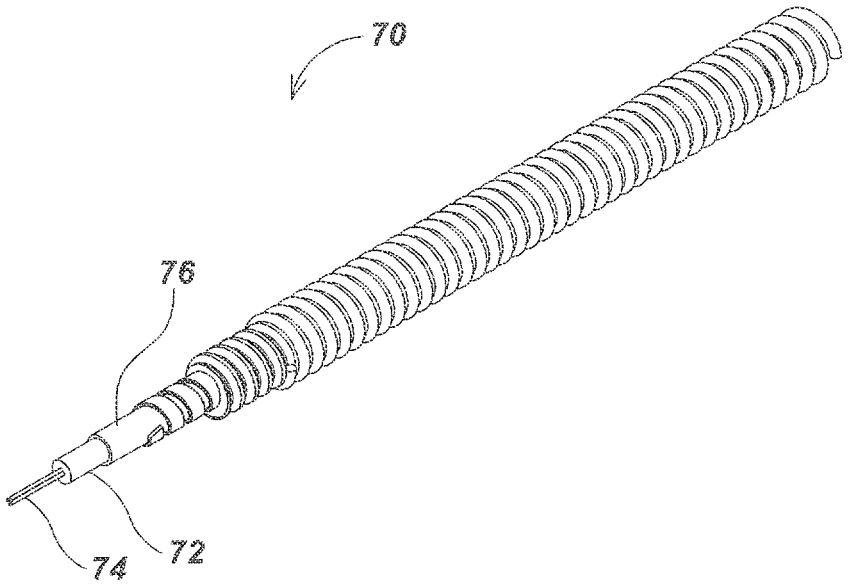
FIG. 7A is a fragmentary isometric view of a sewer cable in accordance with a fifth embodiment.
Figure 7B:
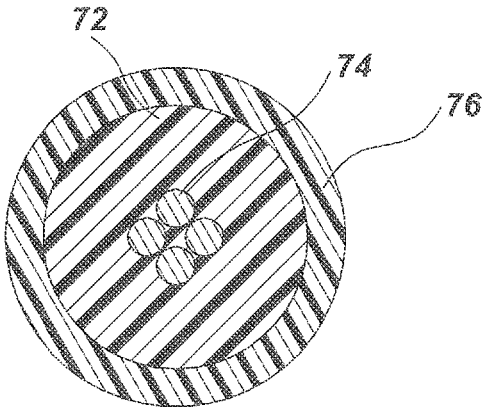
FIG. 7B is an enlarged cross-sectional view of the core member of the embodiment of FIG. 7A illustrating its centrally located wires.
Figure 7C:
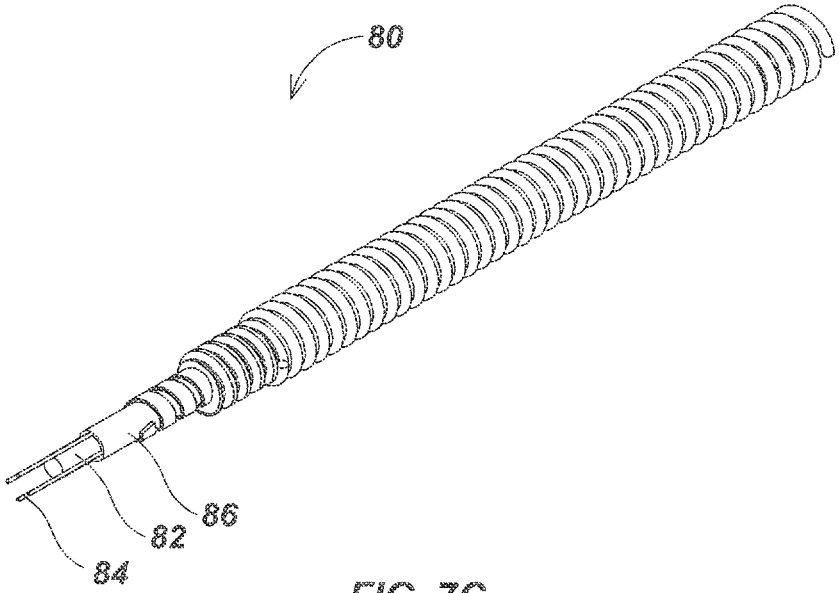
FIG. 7C is a fragmentary isometric view of a sewer cable in accordance with a sixth embodiment.
Figure 7D:
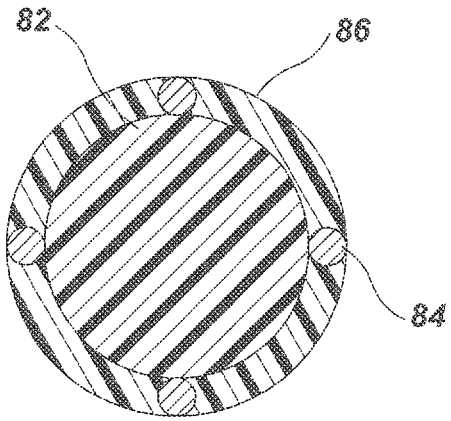
FIG. 7D is an enlarged cross-sectional view of the core member of the embodiment of FIG. 7C illustrating its externally located and insulated conductors.

Another embodiment of a sewer cable 80 in accordance with the present invention is illustrated in FIG. 7C. It has a construction similar to the sewer cable 50 of FIG. 5C except that the non-metallic core member 82 (FIG. 7D) has four externally located conductors 84 and a protective jacket 86 made of Nylon or other suitable material surrounds the conductors 84 and core member 82.

Figure 8A:
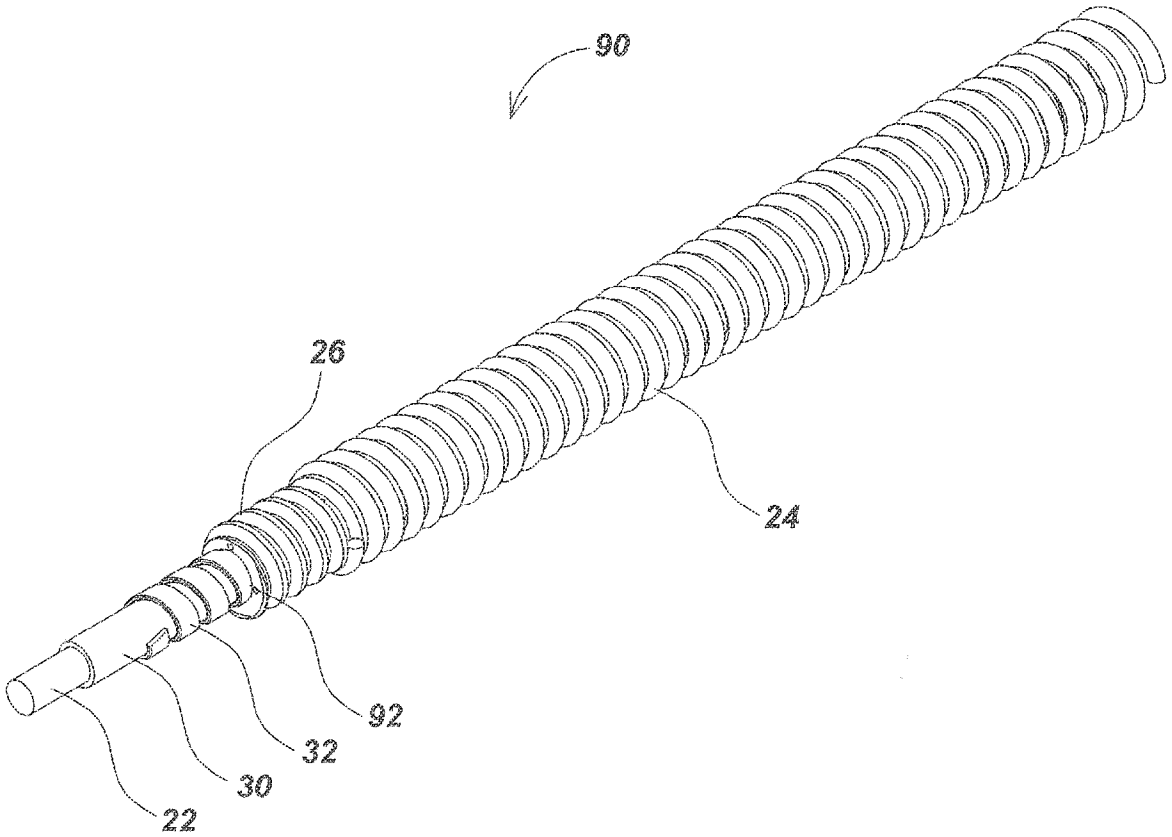
FIG. 8A is a fragmentary isometric view of a sewer cable in accordance with a seventh embodiment that includes voids in the spacer for fluid transmission.
Figure 8B:
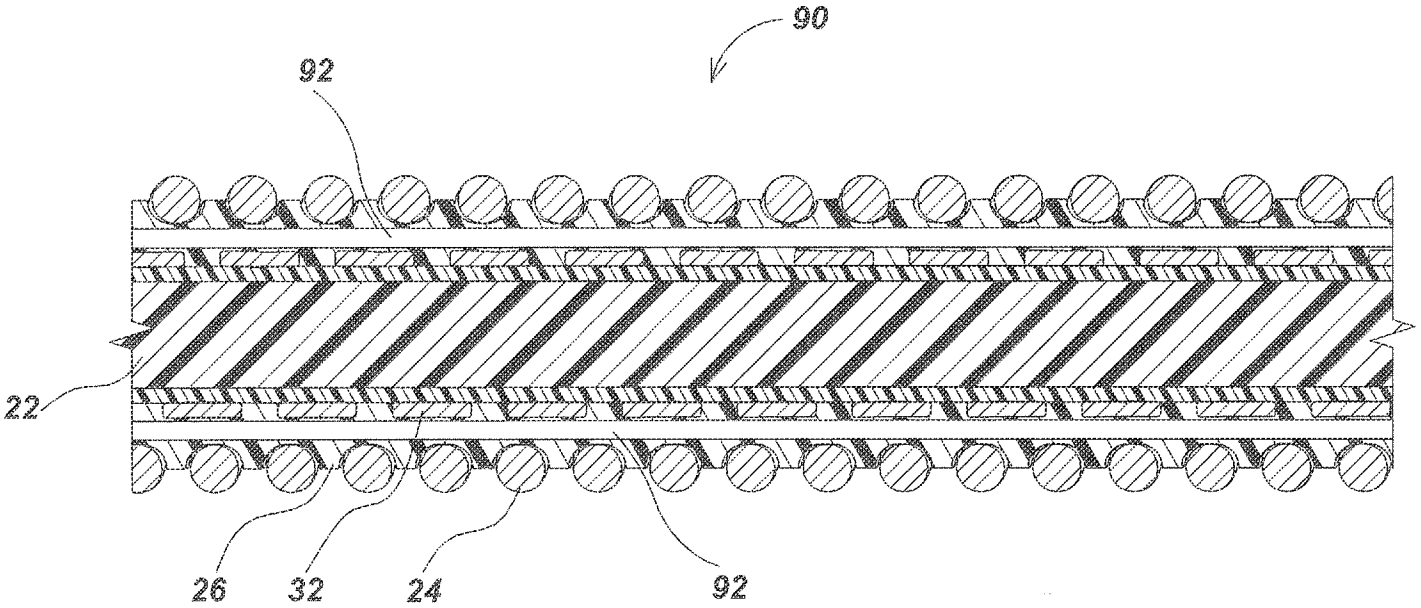
FIG. 8B is a longitudinal sectional view of the sewer cable embodiment of FIG. 8A.

Another embodiment of a sewer cable 90 in accordance with the present invention is illustrated in FIGS. 8A and 8B. It is similar in construction to the sewer cable 20 of FIGS. 4A and 4B except that the sewer cable 90 of FIGS. 8A and 8B has one or more circumferentially spaced, longitudinally extending voids 92 formed in the non-metallic spacer 26. The voids 92 are dimensioned for transmitting high pressure fluid to a jetting head (not illustrated). The voids 92 can also be used to transmit high pressure gases.

Figure 9:
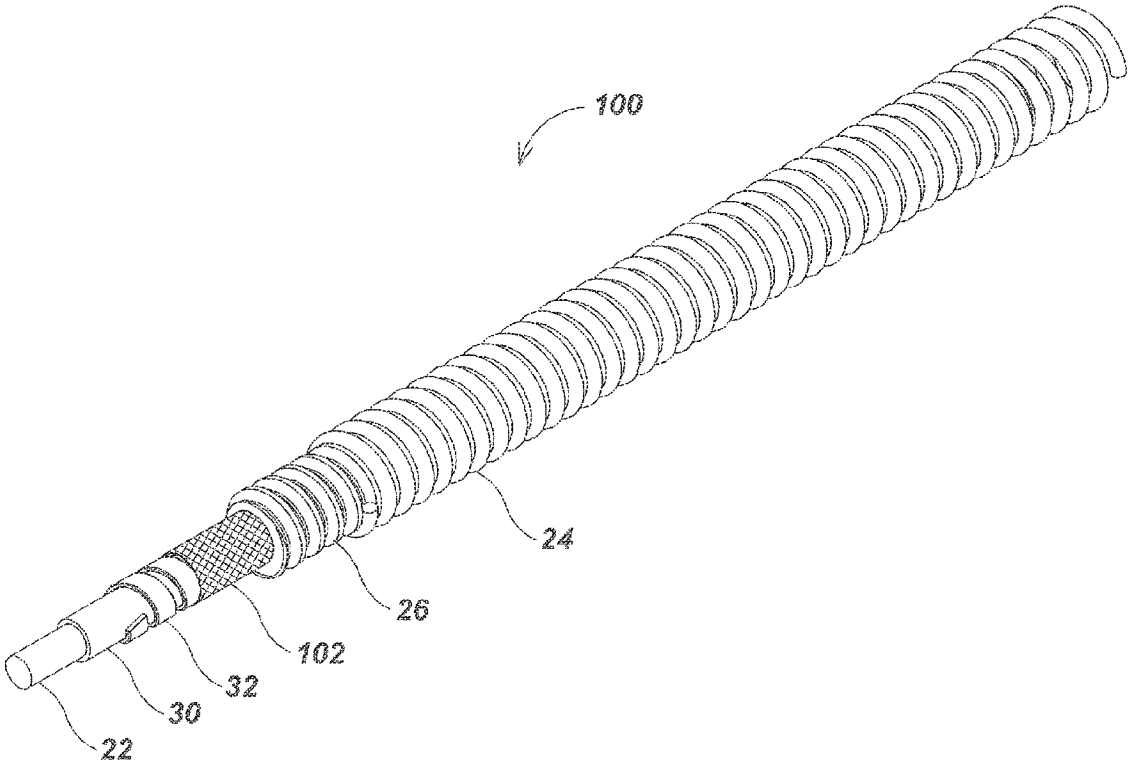
FIG. 9 is a fragmentary isometric view of a sewer cable in accordance with an eighth embodiment of the invention that is similar to the embodiment of FIGS. 4A and 4B, and in addition, includes a braided steel layer that surrounds the helical flat wire.

Another embodiment of a sewer cable 100 in accordance with the present invention is illustrated in FIG. 9. It is similar in construction to the sewer cable 20 of FIGS. 4A and 4B except that the sewer cable 100 of FIG. 9 includes a steel braid 102 tightly woven over the helical flat wire 32 to further strengthen the sewer cable 100, particularly with respect to counter-torque (unwind) forces.

Figure 10A:
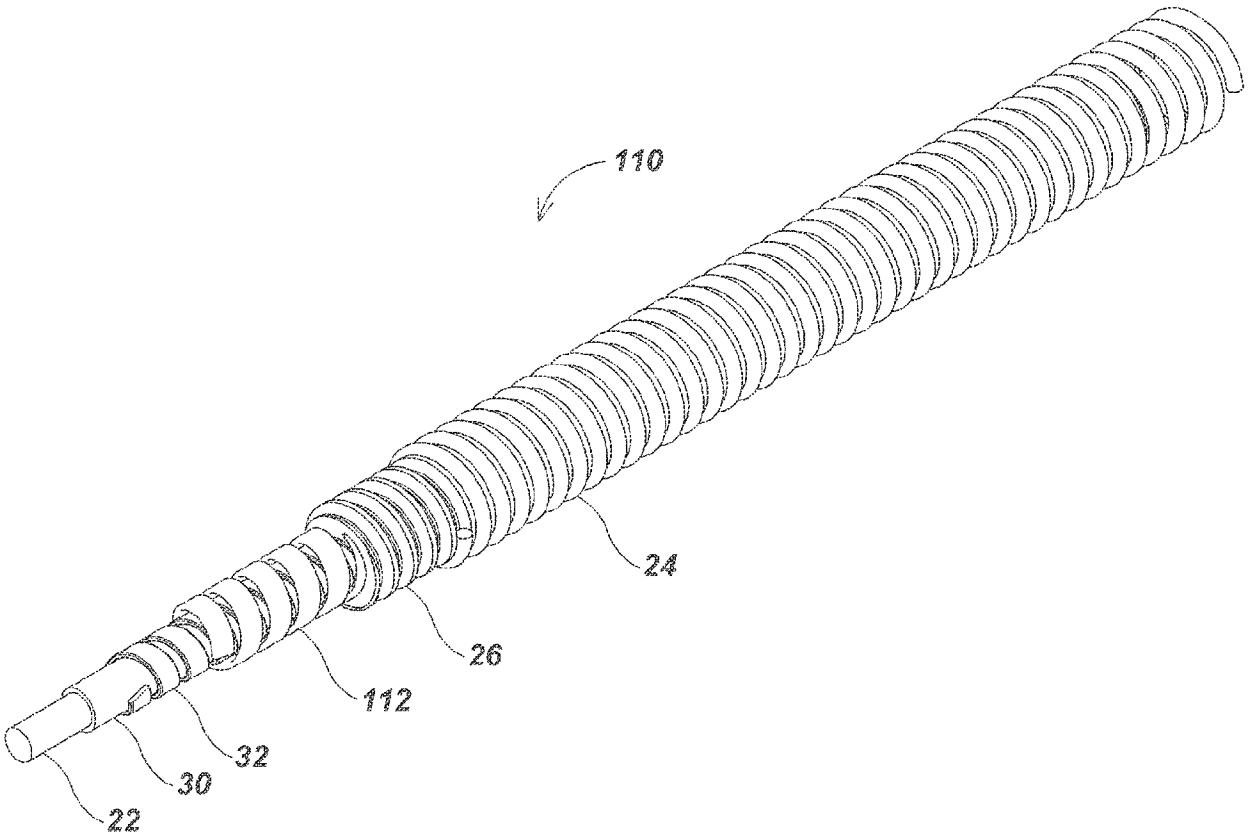
FIG. 10A is a fragmentary isometric view of a sewer cable in accordance with a ninth embodiment of the invention that includes inner and outer helical flat wires.
Figure 10B:
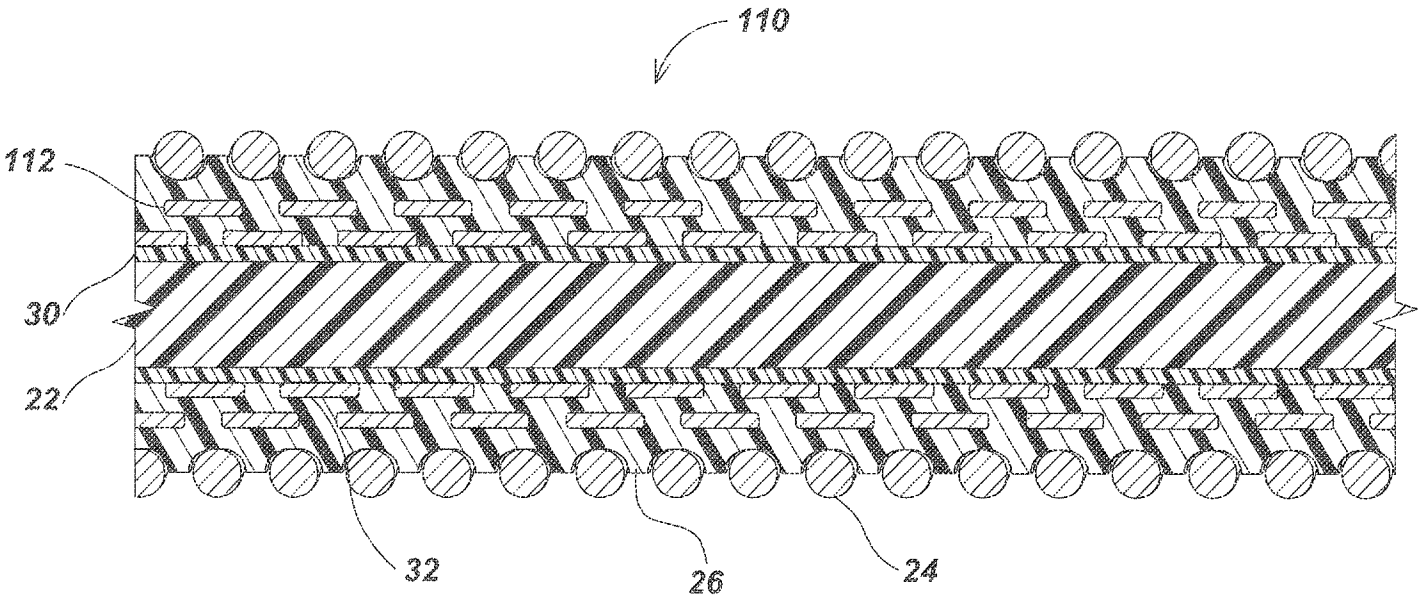
FIG. 10B is a longitudinal sectional view of the sewer cable of FIG. 10A.

Another embodiment of a sewer cable 110 in accordance with the present invention is illustrated in FIGS. 10A and 10B. The sewer cable 110 is similar to sewer cable 20 of FIGS. 4A and 4B, and in addition, includes a second elongate helical flat wire 112 between inside the spacer 26 and wound in a direction opposite that of the first elongate helical flat wire 32. The incorporation of elongate helical flat wires 32 and 112 wound in opposite directions desirably ensures that a minimum amount of torsional load will be transmitted to the core member 22.

Figure 11:
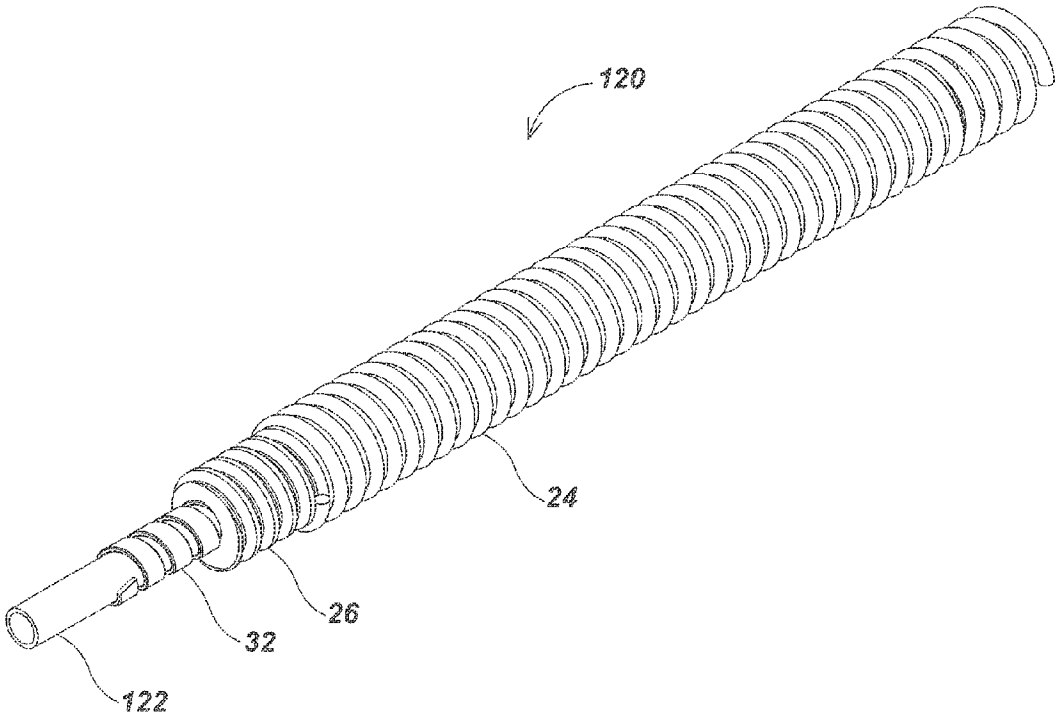
FIG. 11 is a fragmentary isometric view of a tenth embodiment that includes a tubular core.

Referring to FIG. 11, in yet another embodiment 120 the solid core member 22 of the sewer cable 20 can be replaced with a resilient, flexible hollow tube 122 to provide a conduit for delivering high pressure fluid to a jetting head (not illustrated) coupled to the distal end of the modified sewer cable 120.

Figure 12A:
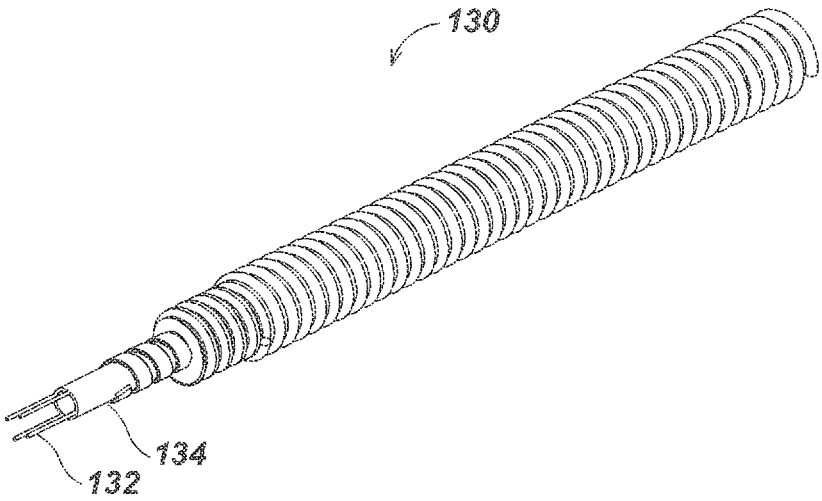
FIG. 12A is a fragmentary isometric view of a sewer cable in accordance with an eleventh embodiment that includes a tubular core with embedded conductors.
Figure 12B:
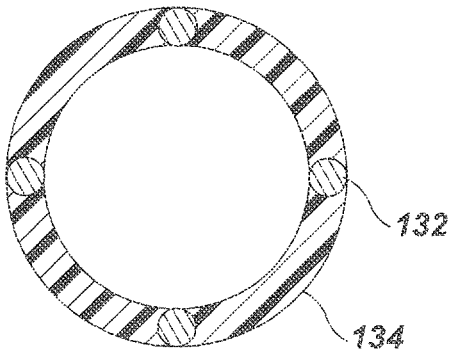
FIG. 12B is an enlarged cross-sectional view of the core member of the embodiment of FIG. 12A illustrating its embedded conductors.

Referring to FIGS. 12A and 12B, in another embodiment 130 electrical conductors 132 are embedded in the outer wall of a central tube 134. In another embodiment 140 (FIG. 13A) insulated wires 142 (FIG. 13B) are routed through the central passage of a central hollow tube 144.

Figure 14:
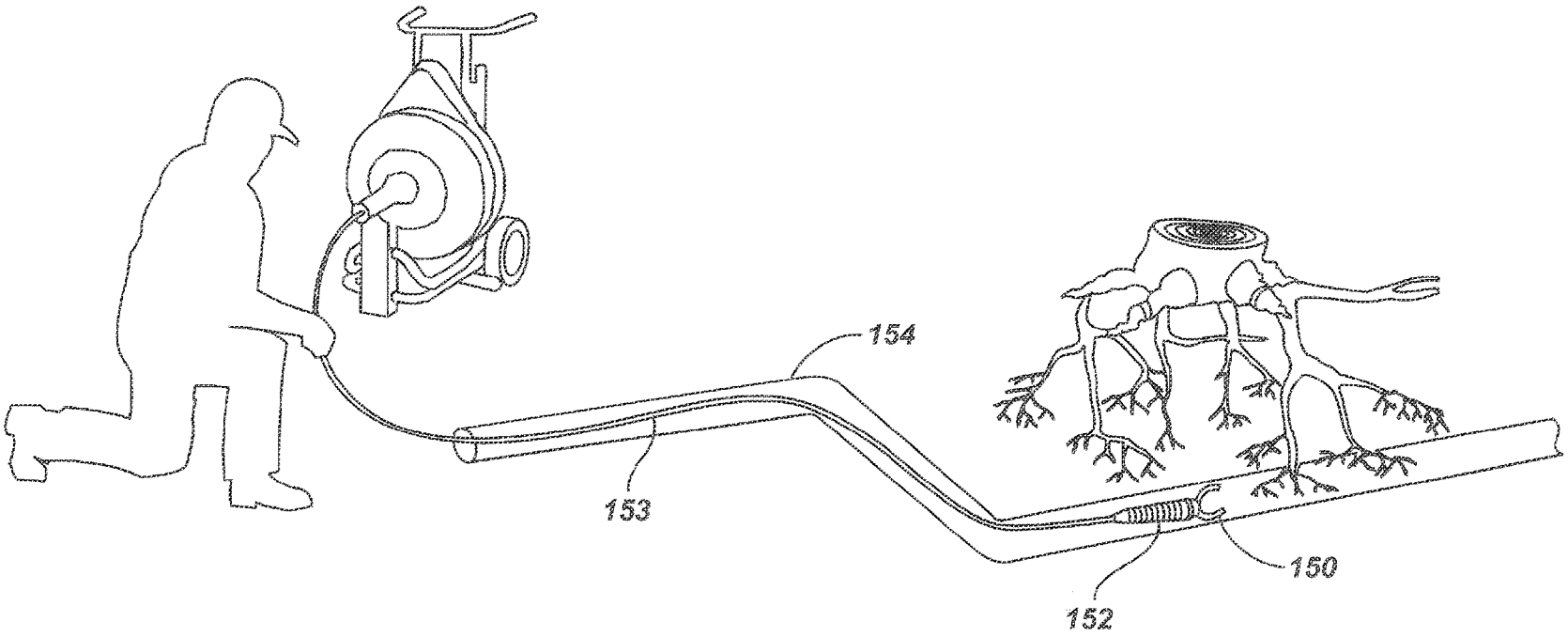
FIG. 14 illustrates a technician clearing roots from a subterranean pipe using a cutting head rotated by a sewer cable in accordance with the present invention that has conductors operatively coupled to a camera head associated with the cutting head.

Referring to FIG. 14, a cutting head 150 and a camera head 152 can both be coupled to the distal end of a lightweight sewer cable 153 of the type disclosed herein that incorporates wires or conductors, such as the sewer cable 80 of FIG. 7C. The camera head 152 can be mounted or held with radial fins (not illustrated) that engage the inner wall of the pipe 154 so that the camera head 152 does not rotate with the sewer cable 20, while the cutting head 150 is rotated by the sewer cable 20 to clear obstructions.

Figure 13A:
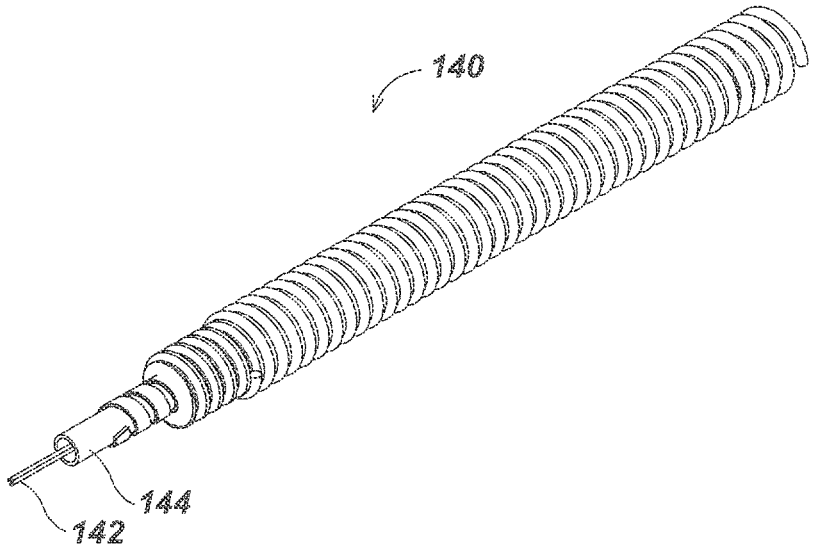
FIG. 13A is a fragmentary isometric view of a sewer cable in accordance with a twelfth embodiment that includes a tubular core with centrally located wires.
Figure 13B:
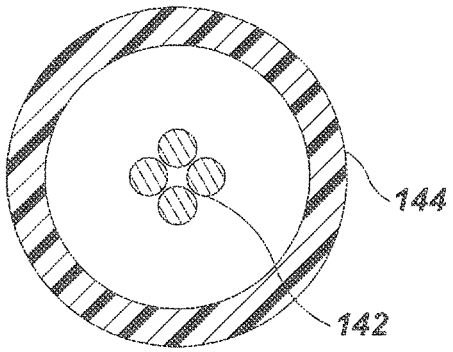
FIG. 13B is an enlarged cross-sectional view of the core member of the embodiment of FIG. 13A illustrating its centrally located wires.
Figure 15:
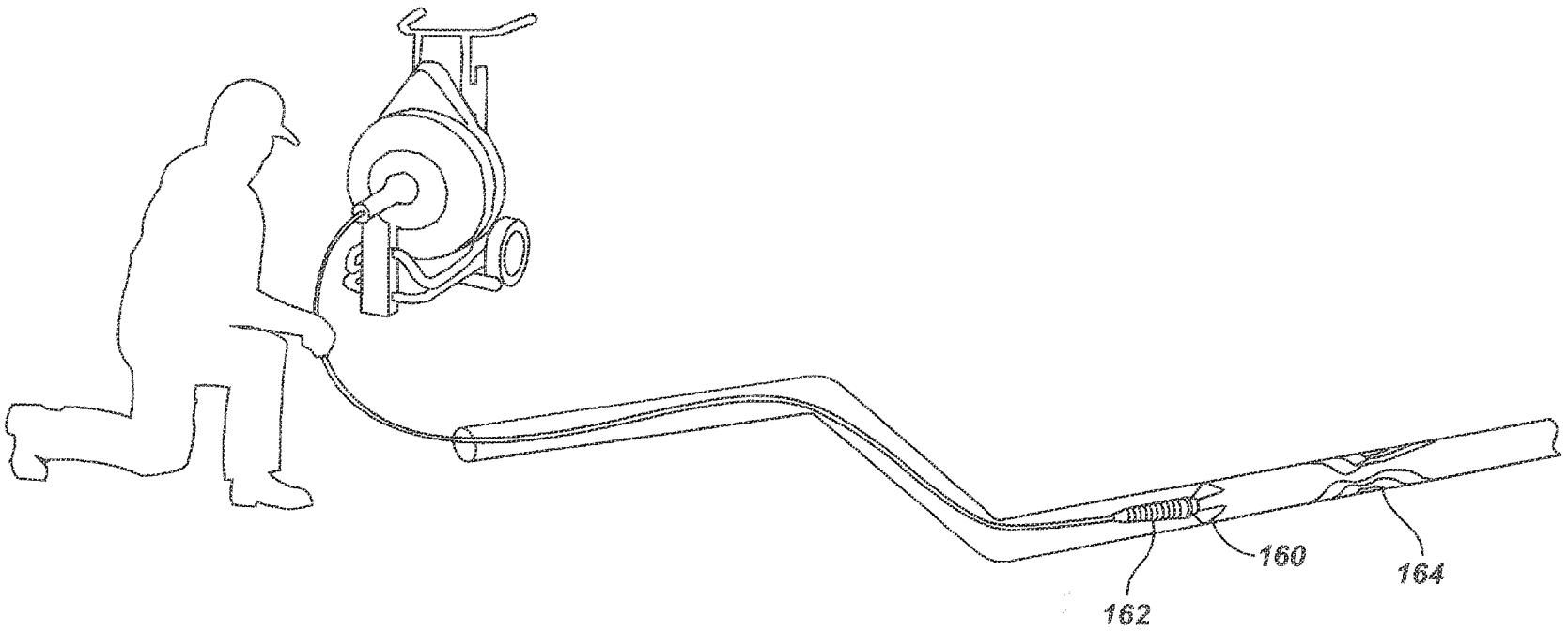
FIG. 15 illustrates a technician clearing grease from a subterranean pipe using a jetting head connected to a sewer cable embodiment that has a fluid passage coupled to a jetting head.

FIG. 15 illustrates a combination jetting head 160 and camera head 162 operatively coupled to the sewer cable 140 of FIG. 13A for clearing grease 164.

While several embodiments of a lightweight sewer cable have been described, those skilled in the art will appreciate that the aspect and embodiments disclosed herein can be modified in arrangement and detail. For example, a flexible transmitter could be incorporated into the sewer cable or the coupling between the sewer cable and the rear of the cutting head, camera head and/or jetting head. More details of such flexible transmitters are found in U.S. Pat. No. 6,958,767 granted Oct. 25, 2005, and my U.S. patent application Ser. No. 10/886,856 filed Jul. 8, 2004 (now U.S. Pat. No. 7,221, 136), the entire disclosures of which are incorporated herein by reference. The flat wire 32 could be replaced with a round wire spring or a round wire that is flattened on only the inner surface facing the central axis of the sewer cable. The flat wire 32 has the advantage of not biting into the jacket 30, and providing a broader surface that applies a tightening force more quickly and avoiding point or lines stresses in the outer fibers of the core member 22. However, round wire may be less expensive and suitable in some 25 applications. The outer coil spring 24 can be omitted and only an inner spring, such as flat wire 32, can be used to transmit the torque. In this alternate embodiment a modified version of the spacer 26 without any external groove constitutes the outer surface of the sewer cable. The spacer 26 and jacket 30 can be made from the same material and extruded in a single operation so the construction is monolithic and accommodates one, two or three springs. The flat wire 32 could be wound directly on the core member 22 with no intervening jacket 30.

The previous description of the disclosed embodiments is provided to enable any person skilled in the art to make or use embodiments of the present disclosure. Various modifications to these embodiments will be readily apparent to those skilled in the art, and the generic principles defined herein may be applied to other embodiments without departing from the spirit or scope of the disclosure. Thus, the presently claimed invention is not intended to be limited to the embodiments shown herein but is to be accorded the widest scope consistent with the following claims and their equivalents.

I claim:

1. A device for clearing pipe obstructions, comprising:

a push-cable structure disposed for insertion into a pipe for clearing obstructions that includes;

an elongate central resilient non-metallic core member made of a composite material including fibers held together with a binder;

an elongate jacket surrounding the core member;

an elongate helical flat metal wire surrounding the jacket; and an elongate helical metal coil spring surrounding the helical flat metal wire.

2. The device of claim 1, further comprising an elongate non-metallic spacer between the helical flat metal wire and the helical metal coil spring;

wherein the spacer includes a helical groove configured to receive the coil spring and maintain the spring in a predetermined pitch so as to maintain a predetermined spacing between adjacent coils of the coil spring.

3. The cable of claim 2, wherein the helical groove has a predetermined size larger than a thickness of the coil spring so as to limit the degree of lateral bending of the cable.

4. The device of claim 2, wherein the spacer comprises one or more of polyethylene, ultra high molecular weight (UHMW) polyethylene, polypropylene, and Nylon.

5. The device of claim 2, further comprising one or more longitudinally extending voids in the spacer for transmitting a high pressure fluid.

6. The device of claim 5, wherein the one or more longitudinally extending voids are circumferentially positioned.

7. The device of claim 5, wherein the one or more longitudinally extending voids comprise a plurality of voids.

8. The device of claim 1, wherein the helical metal coil spring comprises steel.

9. The device of claim 1, wherein the elongate helical flat wire is wound in a first direction and the turns of the helical metal coil are wound in a second direction that is opposite the first direction in which the elongate helical flat wire is wound.

10. The device of claim 1, further comprising a second elongate helical flat metal wire wound about the elongate helical flat metal wire.

11. The device of claim 10 wherein the elongate helical flat metal wire is wound in a first direction and the second elongate helical flat wire is wound in a second direction that is opposite to the first direction that the elongate helical flat metal wire is wound.

12. The device of claim 1, further comprising one or more conductive signal transmitting wires disposed within the core.

13. The device of claim 1, further comprising one or more conductive signal transmitting wires surrounding the core.

14. The device of claim 1, and further comprising a steel braid layer surrounding the elongate helical flat metal wire.

15. A push cable, comprising:

an elongate central resilient core member made of a composite material including fibers held together with a binder;

an elongate jacket surrounding the core member;

an elongate helical flat metal wire surrounding the jacket;

an elongate helical metal coil spring surrounding the helical flat metal wire;

an elongate non-metallic spacer between the helical flat metal wire and the helical metal coil spring; and at least one high pressure fluid cavity extending longitudinally in the spacer;

wherein the spacer includes a helical groove configured to receive the coil spring and maintain the spring in a predetermined pitch so as to maintain a predetermined spacing between adjacent coils of the coil spring.

16. A cable for clearing obstructions in a pipe, comprising:

an elongate central core comprising fibers held together with a binder;

an elongate jacket surrounding the central core;

an elongate helical flat wire surrounding the jacket;

wherein the flat wire tightens against the jacket to limit the amount of torque transferred to the central core member during rotation of the cable while moving the central core in tandem with the jacket and helical flat wire into or out of the pipe.

17. The cable of claim 16, further comprising an elongate helical metal coil spring surrounding the helical flat metal wire.

* * * * *